US006742226B2

(12) United States Patent
Matsuda et al.

(10) Patent No.: US 6,742,226 B2
(45) Date of Patent: Jun. 1, 2004

(54) SLIDE FASTENER

(75) Inventors: Yoshio Matsuda, Toyama-ken (JP); Yoshifumi Nakata, Toyama-ken (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 10/295,541

(22) Filed: Nov. 14, 2002

(65) Prior Publication Data

US 2003/0110602 A1 Jun. 19, 2003

(30) Foreign Application Priority Data

Dec. 13, 2001 (JP) ..... 2001-380218

(51) Int. Cl.[7] ..... A44B 19/36

(52) U.S. Cl. ..... 24/436; 24/381; 24/389; 24/397; 24/419; 24/433

(58) Field of Search ..... 24/436, 397, 435, 24/419, 428, 398, 381, 384, 389, 433, 388

(56) References Cited

U.S. PATENT DOCUMENTS

| | | | | | |
|---|---|---|---|---|---|
| 2,341,331 | A | * | 2/1944 | Parkin | 24/436 |
| 2,625,726 | A | * | 1/1953 | Austin | 24/433 |
| 2,988,796 | A | * | 6/1961 | Johns | 24/436 |
| 3,672,008 | A | * | 6/1972 | Moertel et al. | 24/436 |
| 3,862,474 | A | * | 1/1975 | Ebata | 24/436 |
| 3,972,095 | A | * | 8/1976 | Kandou | 24/436 |
| 4,752,992 | A | | 6/1988 | Kondo et al. | |
| 4,782,563 | A | | 11/1988 | Kusayama | |
| 4,817,252 | A | * | 4/1989 | Kusayama | 24/389 |

FOREIGN PATENT DOCUMENTS

| | | |
|---|---|---|
| FR | 1542750 | 9/1967 |
| JP | 63-33529 | 9/1988 |
| JP | 5-31932 | 8/1993 |

* cited by examiner

*Primary Examiner*—Victor Sakran
(74) *Attorney, Agent, or Firm*—Bell, Boyd & Lloyd LLC

(57) ABSTRACT

In a slide fastener made of fabric having a stopper portion composed of thermoplastic synthetic resin material, the fastener tape contains a rough-pattern-structure region at least adjacent to a side of the fastener element row on an inner side of the fastener tape. An end portion of the stopper portion on the inner side of the fastener tape is disposed in the rough-pattern-structure region and fused to a foundation structure of the fastener tape in the rough-pattern-structure region. Thus, even if the length of the stopper portion in the tape width direction is short, the stopper portion does not interfere with a sewing machine foot during sewing, so that the sewing line does not meander even at the position near the fastener element row. Further, the end portion of the stopper portion can be fused and fixed to the foundation structure of the rough-pattern-structure region.

11 Claims, 7 Drawing Sheets

SLIDE FASTENER

BACKGOURND OF THE INVENTION

1. Field of the Invention

The present invention relates to a slide fastener characterized in a stopper portion thereof.

2. Description of the Related Art

The slide fastener comprises a pair of fastener tapes, a plurality of coupling elements mounted on mating side edges of the tapes so as to be coupled with and separated from each other, a slider having a function for coupling/separating the coupling elements and stopper portions for limiting an end of operation of the slider. As the fastener tape, in general, a woven tape obtained by woven warp yarns and weft yarns has been widely used. A warp knitted tape having a warp knit structure has been prevailing.

Conventionally, a metallic stopper device is generally used for the aforementioned stopper portion of a slide fastener. The stopper device has a pawl which is to be pierced into the fastener tape and which can be mounted to the tape by wrapping the elements while being pierced through the tape. However, there was such a risk that the pawl of the metallic stopper device can come into contact with and injure the skin or can come into contact with yarns to be pulled or cut off. Such risk was needed to be prevented. For that reason, the structure of a stopper device itself has been improved so as to prevent the above-described trouble. On the other hand, there has been a proposal to produce a stopper device made of synthetic resin material, as disclosed in, for example, Japanese Utility Model Application Publication No. 63-33529 and Japanese Utility Model Application Publication No. 5-31932. The Japanese Utility Model Application Publication No. 63-33529 relates to a bottom stopper device in which thermoplastic synthetic resin film is fused integrally with fastener elements at one side of the fastener elements. A skirt portion is provided continuously to a main body of the bottom stopper device. The skirt portion has an uneven face at a portion where the fastener tape is bonded to the synthetic resin film. The skirt portion has a high-density portion in which material of the synthetic resin film exists densely and a low-density portion in which material of the synthetic resin film exists coarsely.

Because the bonding faces of the fastener tape and the synthetic resin film at the skirt portion are formed uneven, the bonding area becomes larger so that the bonding strength can be higher than a case where the bonding face is flat. Further, because the fastener tape portion at the skirt portion is formed with the high-density portion in which the synthetic resin film exists densely and the low-density portion in which it exists coarsely, the bonding strength between the fastener tape and the synthetic resin film can be intensified by the high-density portion. Furthermore, flexibility at the skirt portion can be maintained by the low-density portion, so that the synthetic resin film is prevented from separating from the fastener tape. Further, the stopper portion can be prevented from being broken at the skirt portion.

On the other hand, the Japanese Utility Model Application Publication No. 5-31932 relates to a top stopper device made of thermoplastic synthetic resin and having a U-shaped section, which is attached to an end portion of each fastener element row mounted along each of opposing side edges of right and left fastener tapes. Through holes are formed on an inner side of each of the fastener element row of the fastener tape. An end portion of the top stopper device having a U-shaped section is extended so as to close the through hole.

The end portion is then fused and integrated through the through holes. Thus, an inverted portion is formed so that it can swing with respect to the integrated portion in a sliding direction of a slider.

With such a structure, particularly the end portion of the top stopper device, with which a flange of the slider come into contact, is fused and integrated firmly through the through holes provided in the fastener tape. Further, part of fused resin penetrates into the fastener tape and hardens. At the same time, front and rear leg portions and the inverted portion of the top stopper device nip a core portion of the fastener tape. Thus, even when a strong impact is applied to the top stopper device due to the sliding operation of the slider, the top stopper device would not be removed or dropped, thereby ensuring its stabilized stop function for a long time.

Further, the inverted portion of the top stopper device is so constructed as to be capable of swinging in the sliding direction of the slider. Therefore, if a column of the slider comes into contact with the inverted portion, the inverted portion is deflected in an advancing direction of the slider. Then, the flange of the slider makes contact with an end portion of the top stopper device. Thus, impact applied to the leg portions of the top stopper device by the slider can be eased, thereby protecting the top stopper device from being damaged by such impact.

As already described above, recently there has been a rising tendency that a warp knitted tape is used for a fastener tape of a slide fastener particularly used in clothes, in order to prevent a finished product, to which a fastener tape is sewed, from being waved. Specifically, in a case where a woven fastener tape is sewed to a thin, flexible cloth or it is sewed to a cloth in a curved manner, the finished product is likely to be waved because the woven fastener tape has a fine woven structure in general, which is not extensible with high stiffness. Therefore such sewing of the slide fastener to clothes requires high skill and experience of sewing in order to prevent generation of such waving. On the other hand, a fastener tape composed of a warp knit structure is capable of being stretched/contracted to some extent due to its knit structure. Therefore, the configuration of the fastener tape can be deformed easily so as to conform with the cloth. Thus, in this case, even if the fastener tape is sewed to a thin cloth or in a curved manner, no waving is generated.

As described above, the slide fastener which is to be sewed to clothes is required to be safe first. Further, the slide fastener, particularly a fastener tape of the slide fastener, is required not to be conspicuous with respect to a product to which the slide fastener is sewed. Specifically, women's clothes such as skirt or underwear have been strongly demanded not to have its slide fastener seen from outside. Thus, currently, the slide fastener is sewed to a cloth as close to fastener elements as possible so that the fastener tape can hardly be seen in appearance.

However, as shown in by FIGS. 1 to 3 of the above-mentioned Japanese Utility Model Application Publication No. 63-33529 or FIGS. 3 to 6 in the above-mentioned Japanese Utility Model Application Publication No. 5-31932, each fixing end portion of conventional top and bottom stopper devices is largely extended more inwardly of a fastener tape than end faces of connecting portions for connecting upper/lower leg portions of fastener elements. Consequently, when the slide fastener is sewed to a cloth, the sewing machine foot makes contact with the fixing end portions of the top/bottom stopper portions, so that the sewing machine foot is deflected in a width direction of the slide fastener thereby having the sewing line meander. Consequently, not only appearance of the finished product is damaged due to conspicuousness of the meandering of the sewing line but also in the case of a thin cloth, it gets tense at the meandering portion thereby further harming the appearance further.

As already described, a proper function of the top/bottom stopper devices is to restrict the top and bottom positions of the slider for opening/closing a slide fastener and to prevent the slider from slipping out. However, the existence of the top/bottom stopper devices must not harm the appearance of cloth on which the slide fastener is attached, as well.

SUMMARY OF THE INVENTION

Accordingly, the present invention has been achieved to solve these problems. Therefore, an object of the present invention is to provide a slide fastener in which its sewing line does not meander when the slide fastener is sewed to a cloth, the sewing line can be provided as close to fastener elements as possible, and top/bottom stopper portions can be mounted to a fastener tape firmly while the fastener's proper function is not damaged.

The above-described object can be achieved effectively by the present invention.

According to the present invention, there is provided a slide fastener having a stopper portion made of thermoplastic synthetic resin material at an end portion of a fastener element row mounted along a side edge of a fastener tape made of fabric, wherein the fastener tape has a rough-pattern-structure region at least adjacent to a side of the fastener element row on an inner side of the fastener tape, and an end portion of the stopper portion on the inner side of the fastener tape is disposed in the rough-pattern-structure region and fused to a foundation structure of the fastener tape in the rough-pattern-structure region.

Usually, a side edge portion of the fabric-made fastener tape of a slide fastener serves as a fastener element mounting region and is constructed in higher density than the other part of the fastener tape such as a tape main body region. According to the present invention, the rough-pattern-structure region, which has a coarse density, is formed between the fastener element mounting region and the tape main body region, more specifically between front ends of element leg portions and the tape main body region. According to the present invention, the end portion of the stopper portion on the inner side of the fastener tape is limited up to the rough-pattern-structure region which is located near the front ends of the element leg portions, so that the dimension of the stopper portion in the tape width direction can be shorter than the conventional ones. At the same time, the stopper portion is placed on a stopper-portion-formation part of the fastener tape in a fused condition, and then, integrated with at least composition yarns of the foundation structure existing in the rough-pattern-structure region to be fused thereto. At this time, the fused resin of the stopper portion penetrates through gaps of the rough-pattern-structure region and is fused to the composition yarns in the same rough-pattern-structure region so that it is fixed firmly.

By restricting the dimension of the stopper portion in the tape width direction, the stopper portion can be smaller. Consequently, when the slide fastener is sewed to the fabric, the sewing machine foot does not come into contact with the stopper portion in the area in which the stopper portion exists, so that the sewing line does not meander locally. As a result, not only the mounting style of the slide fastener is stabilized, but also a product having an excellent appearance can be produced.

Further, according to the present invention, it is preferable that the fastener tape is composed of a warp knit structure and the rough-pattern-structure region is formed between a first wale on an end of the fastener element mounting region on an inner side of the fastener tape and a second wale adjacent to the first wale on the inner side of the tape.

As a knitting yarn to be used for the rough-pattern-structure region, there are, for example, weft in-laid yarn for connecting between wales, sinker loops of tricot knitting yarn, sinker loops of two needle stitch yarn. In the knit structure between the wales formed with such knitting yarns, there exist gaps larger than the ones formed in the wales, thereby ensuring molten resin to penetrate into the foundation structure.

Furthermore, according to the present invention, it is preferable that the fastener tape is composed of a woven structure and the rough-pattern-structure region is formed adjacent to a structure at an end of the element mounting region on an inner side of the fastener tape. This rough-pattern-structure region can be formed by setting for example, the warp-yarn density to be lower than the warp-yarn density in the fastener element mounting region and the tape main body region, thereby ensuring molten resin to penetrate into the foundation structure.

Still further, according to the present invention, it is preferable that fusion of the stopper portion to the foundation structure of the fastener tape in the rough-pattern-structure region is carried out by ultrasonic heating or high frequency heating. The ultrasonic heating and high-frequency heating are performed by self-generation heat. The heating location is concentrated on a contact face between the two members to be fused together. Thus, the physical property of the fused members does not change except in the fused portions thereof, so that the fused portions do not become brittle very much. Additionally, an exposed surfaces of the two members after being fused turns to be beautiful finished surfaces along the configuration of an anvil, which is an ultrasonic horn or high-frequency electrode. Furthermore, because the fusion of small-dimension members such as a stopper portion and a fastener tape, which are the objects of the present invention, is completed in a short time of 2 to 5 seconds, productivity can be enhanced remarkably.

Still further, according to the present invention, it is preferable that the stopper portion is formed by injection molding and fusion of the end portion of the stopper portion to the foundation structure of the fastener tape in the rough-pattern-structure region is executed at the time of the injection molding. In the case of the above-described ultrasonic heating or high-frequency heating, the stopper portion is formed by fusing and integrating a material for the stopper portion, which is formed of a film piece or a resin piece, to the formation place for the stopper portion. According to the present invention, when the fastener tape is inserted into a mold to form the stopper portion together with elements, the stopper portion is formed while limiting the dimension thereof in the tape width direction to be within rough-pattern-structure region as described above. Upon this formation, molding resin for forming a front end of the stopper portion penetrates into the rough-pattern-structure region, so that it is integrated with each composition yarn within the rough-pattern-structure region.

Still further, according to the present invention, it is preferable that the stopper portion is a bottom stopper portion and the bottom stopper portion has a swollen portion on substantially a center of a surface thereof extending across the fastener element row in the tape width direction. As described previously, extended portions of an ordinary bottom stopper portion, which is extended from its main body portion covering right and left fastener elements in the tape width direction and which are fixed to the fastener tape, are long and thick to some extent. For this reason, when a slide fastener is opened by sliding a slider downward, the slider flanges come into contact with the bottom stopper portion, so that the slider cannot slide any more.

However, if it is intended to form a conventional slide fastener with the bottom stopper portion having not only a small length in the tape width direction as in the present invention, but also a small thickness, the stopper portion is likely go into an element guide groove of the slider so that when its pull is pulled downward, the slider can escape from the fastener element rows. Thus, according to the present invention, a swollen portion extending across the fastener element rows in the tape width direction is formed substantially in the center of the surface of the bottom stopper portion. When the slider is slid downward in order to open the slide fastener, part of the bottom stopper portion is received in the element guide groove of the slider. At this time, the swollen portion comes into contact with at least rear end faces of the upper and lower wings of the slider, so that the slider cannot be moved further with part of the bottom stopper portion engaging the element guide groove of the slider.

Still further, according to the present invention, preferably, the material of the bottom stopper portion is composed of a laminated film piece having two or more layers while at least material of the bottommost layer has adhesiveness with respect to the composition fibers of the fastener tape, or alternatively at least the material of the topmost layer of the laminated film piece having two or more layers is composed of a material having a higher melting point than the other layers.

The material to be used for the bottom stopper portion may be different from the material to be used for the fastener tape. For example, a modified polyester film having a lower melting point is employed for the bottom stopper portion while nylon having a higher melting point than the modified polyester film is employed for the composition yarns of the fastener tape. However, the polyester resin and nylon resin have low adhesive property. Thus even if the modified polyester resin is fused to the nylon resin, it may be separated because its adhesion is weak.

Thus, the present invention is preferable especially in the case that the bottom stopper portion and the fastener tape are composed of different materials, particularly their adhesion are weak. According to the present invention, the material having excellent adhesive property with respect to the composition yarns of the fastener tape is used for at least the bottommost layer of the material of the bottom stopper portion to be fused. Further, in the present invention, it is preferable that the bottom stopper portion and the fastener tape are composed of the same material, which is most preferable when only the bottom stopper portion is fused to the composition yarns of the fastener tape without melting the composition yarns.

Still further, according to the present invention, it is preferable that the side of the fastener element row on the inner side of the fastener tape is disposed in said rough-pattern-structure region.

DESCRIPTION OF EMBODIMENTS

Hereinafter, embodiments of a slide fastener of the present invention will be described in detail with reference to the accompanying drawings.

Figure 1:
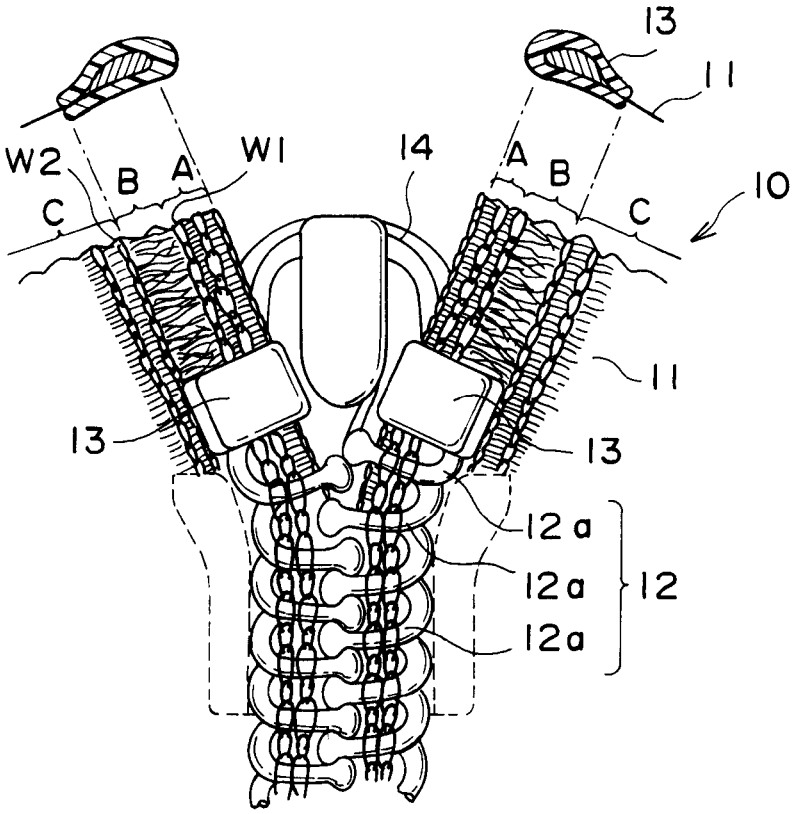
FIG. 1 is an explanatory view showing a structure of a top stopper portion being mounted to a fastener tape of a slide fastener according to a first embodiment of the present invention.

FIG. 1 shows a partial plan view of a major part of a slide fastener as viewed from its rear side including a sectional view of a top stopper portion, according to a typical embodiment of the present invention.

In FIG. 1, reference numeral 10 denotes a slide fastener. A coil-shaped continuous fastener element row 12 made of monofilament is sewed along each of opposing side edges of a pair of fastener tapes 11 with sewing threads 18. Each of the fastener tapes 11 is comprised of a warp knit structure. Top stopper portions 13 made of thermoplastic synthetic resin are formed integrally with the fastener tapes 11 respectively such that they adjoin end portions of the respective fastener element rows 12. Reference numeral 14 in the drawings denotes a slider. The slide fastener 10 is opened/closed by sliding the slider 14 forward and backward. The aforementioned top stopper portion 13 confines an upper limit of the sliding position of the slider 14 so as to prevent the slider 14 from slipping out of the top of the slide fastener 10.

According to this embodiment, the top stopper portion 13 is formed of thermoplastic synthetic resin, for example, modified polyester, which is bent in a substantially U shape. The top stopper portion 13 is fused integrally to an end portion of a space portion adjacent to the top end of the fastener element row 12 located at a fastener element mounting region A in the fastener tape 11, which is composed of polyester fibers, by means of self heat generation as well as pressing using ultrasonic heating. As the material for the fastener element row 12, resin having a higher melting point than polyester, for example nylon, is employed. If the melting point of the fastener tape 11 is set higher than that of the top stopper portion 13, the fastener tape 11 can be protected from being melted and only the top stopper portion 13 is melted thereby inducing no fragility of the fastener tape 11.

For the integration by fusing, according to this embodiment, a position of an end portion of the top stopper portion 13 on the side of a tape main body region C is disposed at a rough-pattern-structure region B of the fastener tape 11. The rough-pattern-structure region B is formed adjacent to an outside end face of a connecting portion 12*c* of each element portion 12*a* of the fastener element row 12 opposite to a coupling head 12*b*. The end portion of the top stopper portion 13 on the side of the tape main body region C is fused by self heat generation and pressing with an ultrasonic horn (not shown), so that the fused resin from upper/lower front end portions of the top stopper portion 13 invades into the foundation structure of the rough-pattern-structure region B. Consequently, the fused resin is affixed to composition yarns of the foundation structure, so that the upper/lower front end portions are fused integrally with each other and fixed firmly. In this case, the physical property of the outside surface of the top stopper portion 13 is not changed and keeps a beautiful finished surface.

As shown in FIG. 1 schematically, the fastener tape 11 having the above-described warp knit structure of this embodiment has the fastener element mounting region A for the fastener element row 12, which is formed of a plurality of wales composed of mainly plural chain stitches. The rough-pattern-structure region B formed between the fastener element mounting region A and the tape main body region C connects a chain-stitch wale W1 of the fastener element mounting region A nearest to the tape main body with a chain-stitch wale W2 of the tape main body region C nearest to the fastener element mounting region A. For example, the rough-pattern-structure region B is constituted of weft in-laid yarns and/or sinker loops of tricot knitting or two-stitch knitting, having a low knitting density with many gaps. The illustrated structure and yarn intervals are exaggeratedly enlarged to show the simplest knit structure for the purpose of easy understanding. Actual use, the size of the yarn may be chosen arbitrarily while the knitting density is higher and the knit structure is more complicated.

The end portion of said top stopper portion 13 and the side of the fastener element row 12, which are disposed toward the tape main body region C, are disposed in the rough-pattern-structure region B. Specifically, the length of the top stopper portion 13 toward the tape main body region C is formed to be shorter such that the end portion of said top stopper portion 13 does not project toward the tape main body region C excessively beyond the line of the side of the fastener element row 12.

Figure 2:
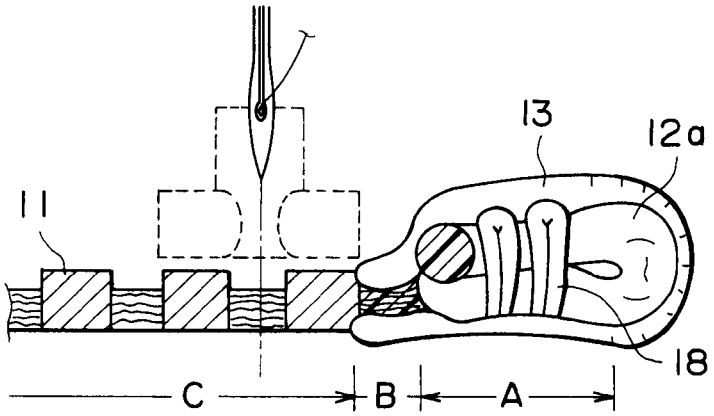
FIG. 2 is a sectional view showing a positional relation between the top stopper portion and a sewing machine foot at the time of sewing.

As described above, the end portion of the top stopper portion 13 nearest to the tape main body is set to be disposed in the rough-pattern-structure region B formed between the fastener element mounting region A and the tape main body region C. Thus, as described above, not only the top stopper portion 13 can be fixed firmly to the fastener tape 11, but also the length thereof in the tape width direction can be reduced. Further, the fastener tape 11 is constituted of knitted fabric having an ample flexibility. Therefore, even if the slide fastener 10 is sewed to women's clothes composed of soft and thin fabric, for example, or the sewing line on the slide fastener 10 needs to be curved, the sewing line is never waved near the top stopper portion 13 and the fabric can be prevented from being tensed. Particularly as shown in FIG. 2, upon sewing, the top stopper portion 13 does not interfere with a sewing machine foot so that the sewing line does not meander along the top stopper portion 13.

(Second Embodiment)

Figure 3:
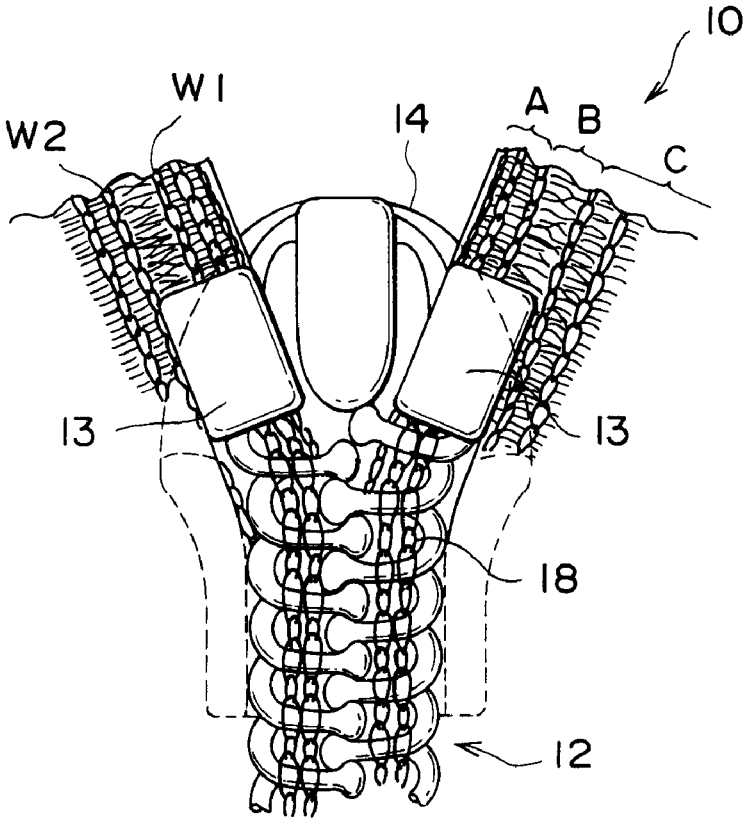
FIG. 3 is an explanatory view showing a structure of a top stopper portion being injection-molded on a fastener tape of a slide fastener according to a second embodiment of the present invention.
Figure 4:
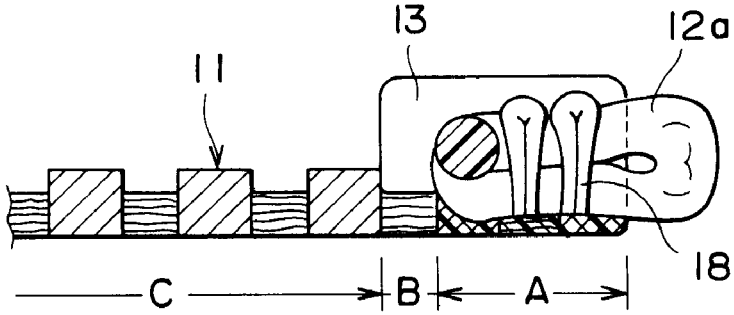
FIG. 4 is an explanatory view schematically showing a section of a mounting portion of the top stopper portion.

FIGS. 3 and 4 show a second embodiment of the present invention. According to this embodiment, a top stopper portion 13 is fused integrally with the fastener element mounting region A of the fastener tape 11 when it is molded by injection molding. According to this embodiment also, the fastener tape 11 is composed of warp knit structure likewise the above-described embodiment. When the top stopper portion 13 is molded, the end portion thereof nearest to the tape main body region C is disposed in the rough-pattern-structure region B which connects the wale W1 of the chain stitch structure disposed nearest to the tape main body region C with the wale W2 of the chain stitch structure of the tape main body region C nearest to the fastener element mounting region A. The slide fastener 10 of this embodiment has the same function as that of the previously described embodiment. The sewed portion of the slide fastener is not waved, the fabric is not tensed locally, and the sewing machine foot does not interfere with the top stopper portion 13 upon sewing, so that the sewing line does not meander along the top stopper portion 13.

(Third Embodiment)

Figure 5:
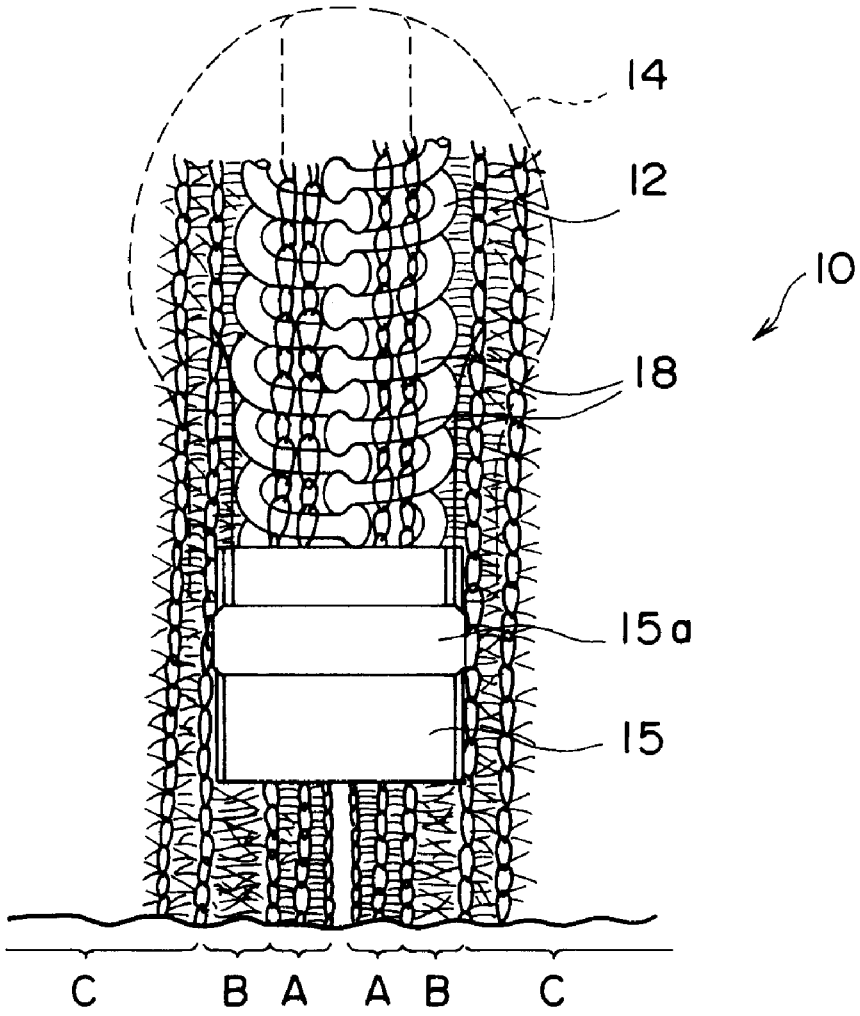
FIG. 5 is a partial top view showing a plane structure of a bottom stopper portion on a fastener tape of a slide fastener according to a third embodiment of the present invention.
Figure 6:
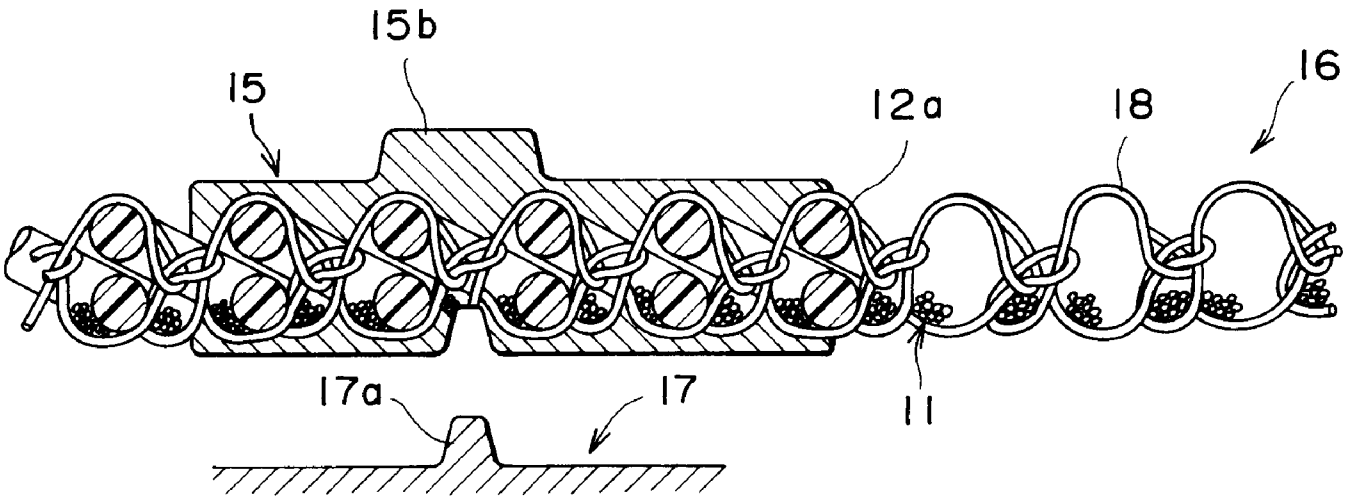
FIG. 6 is a sectional view partially showing configurations of the bottom stopper portion and an anvil when the bottom stopper portion is ultrasonically fused onto the fastener tape.

FIGS. 5 and 6 show a third embodiment of the present invention. This embodiment concerns a bottom stopper portion 15 of the top/bottom stopper portions of the slide fastener 10. This bottom stopper portion 15 is made of thermoplastic film piece, which is fused and integrated with the fastener element mounting region A in the fastener tape 11 while striding over the surface of part of a bottom end of the fastener element rows 12 which are in the coupled state. The end portion of the bottom stopper portion 15 as well as the side of the fastener element row 12, which are disposed toward the tape main body region C, are disposed in the rough-pattern-structure region B. Further, the end portion of the bottom stopper portion 15 does not project toward the tape main body region C excessively as in the first embodiment mentioned above, so that the bottom stopper portion 15 can be small-sized in dimension. The structures of the fastener tape 11 and the fastener element row 12 are the same as those of the first and second embodiments.

A two-layer film is employed for the material of the bottom stopper portion 15 of this embodiment. The bottom stopper portion 15 is fixed to not only the fastener tapes 11 but also element portions 12*a* existing at an end portions of the fastener element rows 12, which is different from the case of the top stopper portion 13. Thus, melting of the fastener element row 12 also makes the configuration of the fastener instable as well as hardens the surroundings of the bottom stopper portion 15. Therefore, it is preferable to melt only the bottom stopper portion 15 and not to melt the fastener tape 11 and the element portions 12*a*, to which the fused bottom stopper portion is to be fused.

According to this embodiment, since the fastener tape 11 is composed of polyester fibers while the fastener element row 12 is made of nylon, it is preferable that material having a lower melting point than the fastener tape 11 and is provided with an excellent adhesion, such as modified polyester, is employed for the fused portion of the bottom stopper portion 15. However, if all the material of the bottom stopper portion 15 is covered with modified polyester resin only, the finished surface of the bottom stopper portion 15 is also melted so that the shape of the bottom stopper portion is deformed. Thus, the shape of the bottom stopper portion cannot be restricted with a mold (ultrasonic horn, high frequency electrode).

Figure 7:
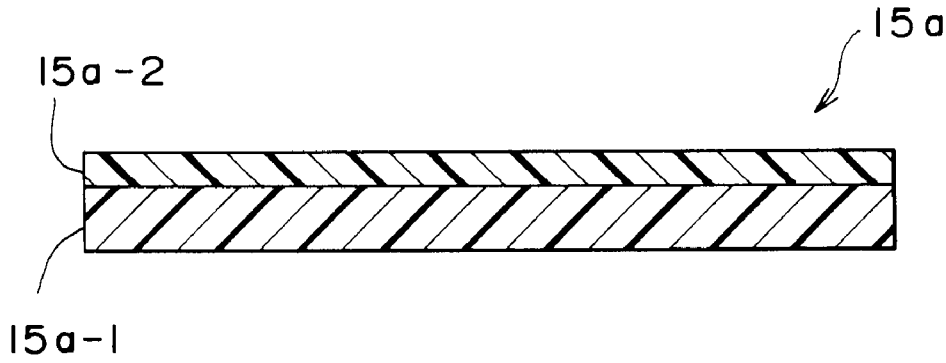
FIG. 7 is an enlarged longitudinal sectional view of a two-layer film, which is a material of the bottom stopper portion.

Thus, this embodiment employs a two-layer film. FIG. 7 shows an example of a two-layer film piece 15*a*, which is a material of the bottom stopper portion 15 obtained from the two-layer film. In this two-layer film 15*a*, a modified polyester resin 15*a*-1 is used for a bottom layer thereof while nylon resin 15*a*-2 is used for a top layer thereof. The two-layer film piece 15*a* is entirely 0.6 mm thick, in which the top nylon layer is 0.2 mm thick and the bottom modified polyester layer is 0.4 mm thick. The melting point of the nylon layer is 215 to 263° C., while the melting point of the modified polyester layer is 120° C.

If such materials are employed for the bottom stopper, the bottom layer is melted and bonded firmly to the fastener tape 11 which is made of polyester fibers and has a good affinity with the bottom layer in terms of adhesion but do not fuse with the nylon-made fastener element row having a poor affinity with the bottom layer. Consequently, the bottom stopper portion 15 can be fused firmly with the fastener tape 11 without deforming the shape of the fastener tape 11 and the fastener element row 12 while keeping a stabilized surface configuration.

To form the bottom stopper portion 15 with a thin film piece 15*a* as in this embodiment, it is preferable to employ high-frequency fusion. As for ultrasonic fusion, an ultrasonic horn (not shown) is brought into a press contact with the film piece 15*a* and then, mechanical ultrasonic vibration is applied to the ultrasonic horn. Consequently, heat is generated in a contact face of the film piece 15*a* with respect to the pressed faces of the fastener tape 11 and the fastener element row 12 so as to fuse the contact portion. For this reason, the ultrasonic horn which vibrates mechanically at ultrasonic velocity is made into a press contact with that fused portion, so that the shape of the surface of the bottom stopper portion 15 is slightly deformed.

In the case of high frequency fusion, on the other hand, an anvil, which is a high frequency electrode (not shown), does not vibrate but heat is generated in the contact face of the film piece 15*a* with respect to the pressed face of the fastener tape 11 and the fastener element row 12 due to a high frequency voltage generated between the electrodes, thereby melting the film piece 15*a*. Thus, the shape of the surface of the bottom stopper portion 15 can be finished in a beautiful appearance. For this reason, since the embodiment employs a high frequency fusing means, only the modified polyester resin 15*a*-2 of the bottom layer of the film piece 15*a* comprised of two layers, which has a low melting point, is melted, while the nylon of the top layer is protected from being melted. Further, the bottom stopper portion 15 can secure a beautiful finished surface while keeping its original shape.

In the bottom stopper portion 15 of this embodiment, as shown in FIGS. 5 and 6, the top/bottom end portions thereof are formed in a smaller width as viewed in plan. A rib-shaped swollen portion 15*b* protrudes from a surface of substantially a center of the bottom stopper portion 15, extending from end to end in the tape width direction. If the bottom stopper portion 15 is formed in such a shape as shown in FIG. 5, when a slider 14 slides down to the bottom stopper portion 15 located below, a top end portion of the bottom stopper portion 15 is received in a guide groove of the slider 14 for a coupling fastener element row, so that an end face of a rear of the slider 14 comes into contact with the aforementioned swollen portion 15*b*. Thus, the slider 14 is restricted from a further sliding operation. That is, this prevents the bottom stopper portion 15 from invading into the slider 14 excessively, so that the slider 14 can to start sliding in a smooth manner.

In order to form the aforementioned swollen portion 15*b* of the bottom stopper portion 15, firstly an upper electrode (not shown) is formed with a molding face corresponding to the shape of the surface of the bottom stopper portion 15, while the top face of an anvil 17, which is a lower electrode to be disposed below a fastener chain 16, has a rib 17*a* protruding as shown in FIG. 6. When the fastener chain 16 is received by the top face of the anvil 17 via the rib 17*a*, the rib 17 is pushed up between adjacent loops of sewing threads 18 sewing and attaching the fastener element row 12 of the fastener chain 16. Thus, the swollen portion 15*b* can be formed securely on the film piece 15*a*, which is a material of the bottom stopper portion 15 to be disposed and fused on the surface of the fastener chain 16. Further, the bottom stopper portion 15 of a desired shape can be obtained.

(Fourth Embodiment)

Figure 8:
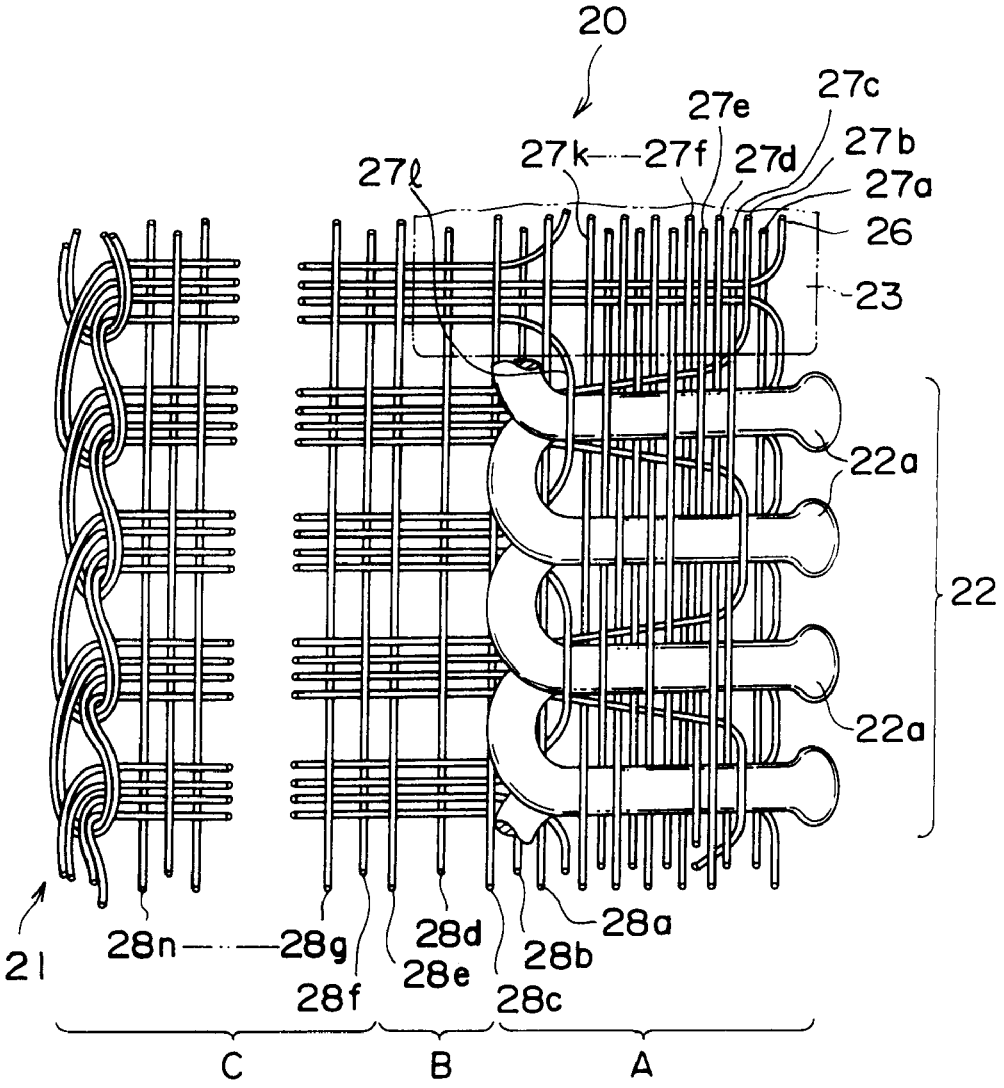
FIG. 8 is an enlarged top view partially and schematically showing a mounting position of a top stopper portion with respect to a woven fastener tape of a woven slide fastener according to a fourth embodiment of the present invention.

FIG. 8 shows part of a slide fastener 20 according to a fourth embodiment of the present invention. According to this embodiment, a fastener tape 21 has a woven structure which is obtained by woven warp and weft yarns. Further, the slide fastener 20 is a so-called woven slide fastener in which continuous coil-shaped fastener elements 22 made of monofilament are woven successively onto one side edge of the fastener tape 21 at the same time when the fastener tape 21 is woven. In this embodiment, of element fixing warp yarns 27 disposed at a fastener element mounting region A, an element fixing warp yarn 27*a* running along a side end portion of the fastener tape 21, which is the closest to a coupling head of an element portion 22*a*, strides over a single pair of double-picked weft yarns and then runs below weft yarns 26 at the next position, which is repeated.

On the other hand, an element fixing warp yarn 27*b*, which runs the second closest to the coupling head of the element portion 22*a*, strides over the top side of an upper leg portion of a single element portion 22*a*. After that, the element fixing warp yarn 27*b* runs below double-picked foundation weft yarns 26 disposed below a lower leg portion of an element portion 22*a* at a next position and then strides over an upper leg portion of a further next element portion 22*a*. The element fixing warp yarn 27*b* repeats this pattern alternately, thereby being woven into the fastener tape 21. Further, an element fixing yarn 27*l*, which runs along the closest position to the connecting portion of the element portion 22*a*, runs over each upper leg portion of adjacent element portions 22*a* successively and then, is bent in the tape width direction. In the tape main body region C, the element fixing yarn 27*l* serves to function as a weft yarn together with the double-picked weft yarns 26.

Warp yarns 28*a* to 28*n* in the tape main body region C of this embodiment are woven in coarser warp density than warp yarns 27*a* to 27*l* disposed in the fastener element mounting region A except a part thereof and its structure is a plain woven structure. According to this embodiment, the three warp yarns 28*a* to 28*c* located adjacent to the element fixing yarn 27*l* running along the closest position to the connecting portions of the element portions 22*a* have substantially the same warp yarn density as the sixth and subsequent warp yarns 28*f* to 28*n* from the element fixing yarn 27*l*. Gaps between the third warp yarn 28*c* from the element fixing yarn 27*l* and the fourth warp yarn 28*d*, and the fifth warp yarn 28*e* are substantially twice larger than the warp yarn density of the other part of the tape main body region C. These three warp yarns 28*c* to 28*e* constitute a rough-pattern-structure region B of the present invention. Further, according to this embodiment, the warp yarns 26, 27*a* to 27*l* running above/under the element portions 22 and the three warp yarns 28*a* to 28*c* from the element fixing yarn 27*l* running along the closest position to the connecting portions of the element portions 22*a* constitute the fastener element mounting region A.

In the weave-in type slide fastener 20 having such a structure as mentioned above, the top stopper portion 23 is formed so as to adjoin a top end of the fastener element row 22 and extend over the entire fastener element mounting region A and part of the rough-pattern-structure region B as shown in FIG. 8. Likewise the first embodiment, this top stopper portion 23 is formed by setting substantially a U-shaped thermoplastic resin piece so as to nip a tape edge portion and then fused to be integrated with the fastener tape 21 by ultrasonic fusion. At this time, an end portion of the top stopper portion 23 on the side of the tape main body is located in the rough-pattern-structure region B and invades into part of the weft yarns 26 and the warp yarns 28*c* to 28*e*, which are the composition yarns of the rough pattern region B and is fused therewith. Thus, the top stopper portion is firmly integrated thereto. As described above, the length of the top stopper portion 23 in the tape width direction is much shorter than conventional ones. Therefore, likewise the above-described embodiments, the top stopper portion 13 does not interfere with a sewing machine foot during sewing, so that the sewing line does never meander along the top stopper portion 13.

(Fifth Embodiment)

Figure 9:
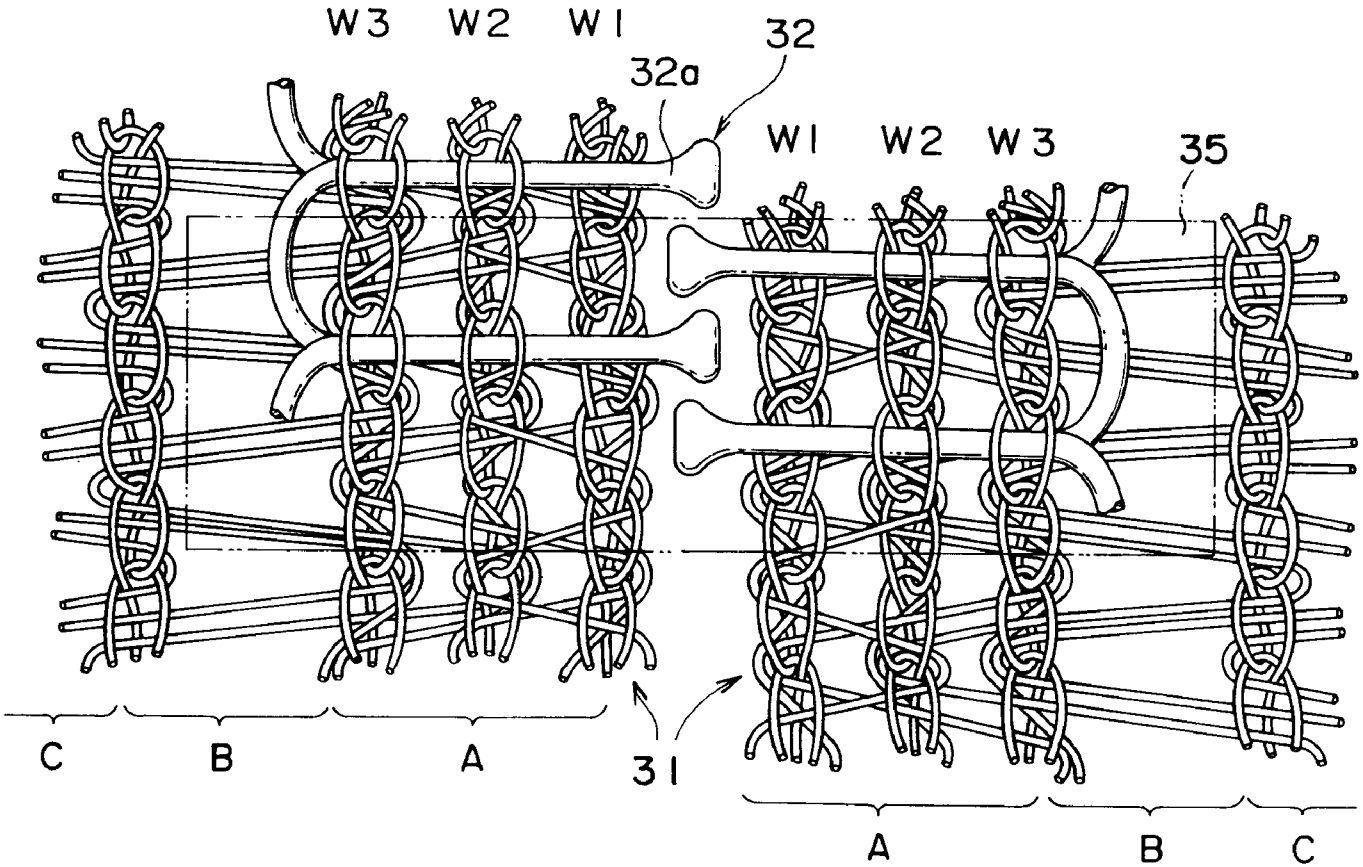
FIG. 9 is an enlarged top view partially and schematically showing a mounting position of a bottom stopper portion to a warp knit fastener tape of a knit slide fastener according to a fifth embodiment of the present invention.

FIG. 9 shows a fifth embodiment of the present invention. According to this embodiment, a fastener tape 31 is a warp knitted tape in which warp yarns are knitted. This Figure shows a so-called knitted fastener chain 30 in which a continuous fastener element row 32 obtained by forming monofilament into a coil shape is knitted in one side edge of a fastener tape 31 thereof at the same time when the fastener tape 31 is knitted. The knitted slide fastener of this embodiment can be produced by means of an ordinary warp knitting machine having a single row of needle bed. The foundation structure of a tape main body region C of this embodiment is formed by chain stitches, tricot stitches and weft in-laid yarns inserted across three wales. According to this embodiment, three wales W1 to W3 on one side edge of the fastener tape 31 serves as a fastener element mounting region A. A wire material to be formed into a coil-shaped fastener element row 32, which is made of plastic monofilament, is knitted into the mounting region A by reciprocating it in every other course in the tape width direction so as to form a continuous fastener element row 32. This fastener element row 32 is knitted into the fastener element mounting region A in every other course and continuously fixed thereto with the fixing chain stitch yarns of two wales W2, W3, each of which is formed in a chain stitch structure 0-1/1-0 in the fastener element mounting region A, at the same time when the coil-shaped fastener element row 32 is formed.

In this case, the fixing chain stitch yarns are knitted in a length direction of the fastener element row 32 such that each needle loop goes across a top side of a leg portion of each element portion 32*a* of the fastener element row 32. Then, the fastener element row 32 is pressed down to the foundation structure with each needle loop group which is continuous in the direction of the wales so that it is fixed in the fastener element mounting region A. At this time, the sinker loop exists below each leg portion of the fastener element row 32 so as to form a sinker loop group continuous in the wale direction, thereby forming part of the foundation structure of the fastener element mounting region A in which the fastener element row 32 is to be knitted. According to this embodiment, a warp inlaid yarn is inserted and knitted into the foundation structure of the fastener element mounting region A in a knit structure of 1-0/0-1 while entangled with all sinker loops of each sinker loop group of the fixing chain stitch yarns. In the meantime, according to this embodiment, the warp in-laid yarns are inserted in a zigzag style not only along the fixing chain stitch yarns of the two wales W2, W3 but also along the chain stitch yarn of the tape foundation structure constructing the wale W1, which is disposed on an outer side of the wales W2 and W3. Consequently, the entire foundation structure of the fastener element mounting region A is provided with feeling and configuration like a woven cloth. Further, the foundation structure is stabilized dimensionally in both the longitudinal and lateral directions, so that the fastener element row 32 is fixed more stably.

Furthermore, according to this embodiment, a rough-pattern-structure region B is formed between the fastener element mounting region A and the tape main body region C. As shown in FIG. 9, a bottom stopper portion 35 formed of a film piece like the previously-described embodiments is integrated with a bottom end portion of the knitted fastener element row 32 by fusion. In this embodiment also, right and left ends of the bottom stopper portion 35 in the tape width direction are located in the rough-pattern-structure regions B of the fastener tapes 21 respectively. The main body of the bottom stopper portion 35 covers part of the bottom end portions of the knitted-in type fastener element rows 32, such that the right and left ends pass between the sinker loops of tricot stitch yarn and the weft in-laid yarns in the rough-pattern-structure region B and then fused to the sinker loops of each tricot stitch yarn and the weft in-laid yarns.

With such a structure of this embodiment also, the length of the bottom stopper portion 35 in the tape width direction can be reduced largely as compared to the conventional ones. Consequently, ends of the bottom stopper portion 35 never protrudes excessively to the tape main body region C. When the knitted slide fastener 30 is sewed to clothes or the like, the sewing line does not meander by the bottom stopper portion 35 coming into contact with the sewing machine foot, as in the previously-described embodiments. Further, because wales between the fastener element row 32 and the tape main body region C is omitted to form the rough-pattern-structure region B, synthetic resin is easy to penetrate when being fused. Therefore the bottom stopper portion 35 can be fixed firmly to the fastener tape 31.

What is claimed is:

1. A slide fastener having a stopper portion made of thermoplastic synthetic resin material at an end portion of a fastener element row mounted along a side edge of a fastener tape made of fabric, wherein said fastener tape has a rough-pattern-structure region where at least a side of said fastener element row on an inner side of the fastener tape enters beyond an element mounting region, and an end portion of said stopper portion on the inner side of the fastener tape is disposed in said rough-pattern-structure region and fused to a foundation structure of the fastener tape in the rough-pattern-structure region.

2. The slide fastener according to claim 1, wherein said fastener tape is composed of a warp knit structure and said rough-pattern-structure region is formed between a first wale on an end of said element mounting region on an inner side of the fastener tape and a second wale adjacent to the first wale.

3. The slide fastener according to claim 1, wherein said fastener tape is composed of a woven structure and said rough-pattern-structure region is formed adjacent to a structure at an end of the element mounting region on the inner side of the fastener tape.

4. The slide fastener according to claim 1, wherein fusion of said stopper portion to the foundation structure of the fastener tape in the rough-pattern-structure region is carried out by ultrasonic heating or high frequency heating.

5. The slide fastener according to claim 1, wherein said stopper portion is formed by injection molding and fusion of the end portion of the stopper portion to the foundation structure of the fastener tape in the rough-pattern-structure region is executed at the time of said injection molding.

6. The slide fastener according to claim 1, wherein said stopper portion is a bottom stopper portion and the bottom stopper portion has a swollen portion on substantially a center of a surface thereof extending across said fastener element row in a width direction of the fastener tape.

7. The slide fastener according to claim 1, wherein said stopper portion is a bottom stopper portion and material of the bottom stopper portion is composed of a laminated film piece having two or more layers while at least material of a bottommost layer thereof has adhesiveness with respect to composition fibers of said fastener tape.

8. The slide fastener according to claim 1, wherein said stopper portion is a bottom stopper portion and material of the bottom stopper portion is composed of a laminated film piece having two or more layers while at least material of a topmost layer thereof is composed of a material having a higher melting point than the other layers.

9. A slide fastener having a stopper portion made of thermoplastic synthetic resin material at an end portion of a fastener element row mounted along a side edge of a fastener tape made of fabric, wherein said fastener tape has a rough-pattern-structure region at least adjacent to a side of said fastener element row on an inner side of the fastener tape, and an end portion of said stopper portion on the inner side of the fastener tape is disposed in said rough-pattern-structure region and fused to a foundation structure of the fastener tape in the rough-pattern-structure region;

wherein said stopper portion is a bottom stopper portion and the bottom stopper portion has a swollen portion on substantially a center of a surface thereof extending across said fastener element row in a width direction of the fastener tape.

10. A slide fastener having a stopper portion made of thermoplastic synthetic resin material at an end portion of a fastener element row mounted along a side edge of a fastener tape made of fabric, wherein said fastener tape has a rough-pattern-structure region at least adjacent to a side of said fastener element row on an inner side of the fastener tape, and an end portion of said stopper portion on the inner side of the fastener tape is disposed in said rough-pattern-structure region and fused to a foundation structure of the fastener tape in the rough-pattern-structure region;

wherein said stopper portion is a bottom stopper portion and material of the bottom stopper portion is composed of a laminated film piece having two or more layers while at least material of a bottommost layer thereof has adhesiveness with respect to composition fibers of said fastener tape.

11. A slide fastener having a stopper portion made of thermoplastic synthetic resin material at an end portion of a fastener element row mounted along a side edge of a fastener tape made of fabric, wherein said fastener tape has a rough-pattern-structure region at least adjacent to a side of said fastener element row on an inner side of the fastener tape, and an end portion of said stopper portion on the inner side of the fastener tape is disposed in said rough-pattern-structure region and fused to a foundation structure of the fastener tape in the rough-pattern-structure region;

wherein said stopper portion is a bottom stopper portion and material of the bottom stopper portion is composed of a laminated film piece having two or more layers while at least material of a topmost layer thereof is composed of a material having a higher melting point than the other layers.

* * * * *